United States Patent [19]

Bruce

[11] 4,098,216

[45] Jul. 4, 1978

[54] APPARATUS FOR RETRIEVING ANCHORS

[76] Inventor: Peter Bruce, "Le Victoria", App. 5e etage, Bloc D, 13 bd. Princesse Charlotte, Monte Carlo, Monaco

[21] Appl. No.: 782,173

[22] Filed: Mar. 28, 1977

[30] Foreign Application Priority Data

Apr. 1, 1976 [GB] United Kingdom ..... 13159/76

[51] Int. Cl.[2] ..... B63B 21/26

[52] U.S. Cl. ..... 114/297; 114/221 R; 294/66 R

[58] Field of Search ..... 294/66 R; 43/17.2; 61/72.3, 69 R; 114/293, 294, 295, 297, 299, 301, 221 R

[56] References Cited

U.S. PATENT DOCUMENTS

| | | | |
|---|---|---|---|
| 2,926,449 | 1/1960 | Rupert | 43/17.2 |
| 3,336,067 | 8/1967 | Cloyd | 294/66 R |
| 3,929,087 | /0000 | Montgomery | 114/297 |

*Primary Examiner*—Trygve M. Blix
*Assistant Examiner*—D. W. Keen
*Attorney, Agent, or Firm*—Mason, Fenwick & Lawrence

[57] ABSTRACT

In the placement of an anchor in the sea bed for mooring of a vessel a chaser in the form of a loop or hook is attached to a service line and the chaser is positioned on the anchor to support the anchor. A service vessel with the service line secured thereto pulls the anchor and anchor chain from the parent vessel to be moored and simultaneously lowers the anchor to the sea bed via the service line. The anchor is subsequently set in the sea bed for mooring and the chaser can then be removed from the anchor chain or returned up the chain to the moored vessel.

To retrieve the anchor, the chaser is run down the anchor chain until it engages the anchor, and the service vessel then pulls the anchor from the sea bed by means of the service line and takes the anchor aboard. The anchor is then returned to the parent vessel.

The present invention provides a chaser wherein the chain engaging surface of the chaser is defined by an arc of radius R not less than twice the chain diameter (D) with the longest chord contained by the arc of length not less than 2.9D. Additionally the chaser includes burial surfaces to produce burial forces transverse to the direction of sliding of the chaser. This arrangement facilitates movement of the chaser along the anchor chain when in the sea bed, and also reduces wear on the chaser caused by rubbing on the chain.

20 Claims, 6 Drawing Figures

APPARATUS FOR RETRIEVING ANCHORS

The present invention relates to a chaser or retrieval device for placement or recovery of a marine anchor at the sea bed.

At present, mobile floating oil drilling platforms and drilling vessels generally use anchor and cable mooring systems wherein placement and recovery of each anchor is achieved by means of a pendant or service line fastened at one end to a rear portion of the anchor and at the other end to a flotation buoy.

The pendant is passed from the drilling vessel to an anchor handling ship which draws the anchor out from its rack on the drilling vessel as the anchor cable is paid out. When the anchor handling ship is over the anchor placement location, additional standard lengths of pendant wire are shackled together as the anchor is lowered to the bottom to give a combined length slightly in excess of the water depth. Finally, the flotation buoy is shackled on the pendant line and heaved overboard prior to setting the anchor by tensioning the anchor cable with the corresponding mooring winch on the drilling vessel. The placement cycle of anchoring is now complete.

Recovery of the anchor is achieved by lassoing the flotation buoy, hauling it on board the supply vessel and detaching it from the pendant line. The pendant line is then shackled on to the anchor handling winch on board and heaved in once the anchor cable has been slackened off by the drilling vessel. Heaving in the pendant line breaks the anchor out of the sea bed and permits the anchor handling ship to remove the added lengths of pendant wire. Once the final length is stoppered off, the drilling vessel heaves in the anchor cable until the anchor is hove home on the anchor rack with the anchor handling ship being pulled towards the drilling vessel in the process. The pendant line is then transferred to the drilling vessel and the recovery cycle of anchoring is complete.

This process involves repeated stoppering-off and shackling operations with heavy wire ropes, typically 2¼ inch diameter, and the handling of a very large heavy buoy. The size of the buoy and the length and weight of the pendant wires increases with water depth and hence so do the costs. The concomitant handling problems additionally place a limit to the depth of water which can be worked and to the wave-heights permissible for safe working.

In view of these disadvantages of the above anchoring procedure, an alternative method of anchoring without using buoy-supported pendant lines has been proposed for use in the offshore drilling industry. This involves the use of a cable riding device, generally known as a "chaser" or anchor retrieval device, attached by a wire rope to an anchor handling ship, and the method is described in U.S. Pat. Nos. 3,927,636, 3,929,087 and 3,921,782.

Usually, the chaser has the form of an open or closed loop of steel which encircles the anchor cable and is stowed adjacent the anchor when the anchor is racked. Attached to the chaser is a wire rope pendant line which is passed to the supply ship as before. The supply ship draws the chaser on to the anchor shank so that the anchor is drawn out as the anchor cable is paid out until the anchor placement location is reached. A long towing line is shackled on to the chaser pendant and paid out until the chaser-borne anchor rests on the sea bed below the anchor-handling ship. The drilling vessel then tensions the anchor cable until the anchor digs into the sea bed (carrying the chaser with it) and provides a pull of about 50 tons. The anchor handling ship next turns round and returns along the anchor cable towards the drilling vessel so that the chaser is hauled off the anchor shank and rides the cable back to the drilling vessel. The towing line is heaved in and unshackled from the chaser pendant which is passed back on board the drilling vessel. The chaser is then hove into a stowed position against the anchor cable fairleader as the anchor is finally tensioned up. Anchor placement is now complete.

Recovery of the anchor is effected by the anchor handling ship drawing the chaser back down the taut anchor cable until it re-engages on the shank of the anchor. The anchor cable is then slackened off and the anchor broken out of the sea-bed by a pull from the anchor handling ship. Heaving in on the towing wire then allows the chaser pendant to be stoppered off on the anchor handling ship whereupon the drilling vessel heaves in the anchor cable until the anchor (and chaser) is hove home on the anchor rack with the supply ship being pulled towards the drilling vessel in the process. The pendant line is then transferred to the drilling vessel and tensioned to stow the chaser on the anchor cable against the anchor cable fairleader. The cycle of anchor placement and recovery is now complete without having used a buoy and with only a single shackle connecting operation having occurred for each round trip of the chaser.

However, the design of prior devices has given rise to problems in the operation of this method of anchoring which are presently preventing the general adoption of the system by the offshore industry. The main problem is failure of the chaser to negotiate the buried portion of an anchor chain cable leading to a deeply buried anchor or failure to negotiate the anchor shackle connection of a deeply buried anchor. This results in the anchor having to be broken out of the sea-bed by pulling up on a bight in the anchor cable whereby very high stresses are induced in the chaser pendant, chaser, anchor cable and anchor with considerable risk of failure of any or all of these. Additionally, the broken out anchor is likely to be in an attitude unsuitable for reliable re-laying and for heaving on board the supply vessel.

It is an object of the present invention to obviate or mitigate this disadvantage.

In particular it is an object of the present invention to provide an anchor chaser of improved form enabling more efficient and effective operation, and especially enabling the chaser to move without snagging along the anchor chain to a deeply buried anchor.

The present invention provides a chaser comprising an anchor grappling member including a loop shaped portion serving to catch and support the anchor for anchor retrieval or placement, said grappling member being adapted for constrained movement along the chain to or from the anchor, a lower part of the loop shaped portion having an inner surface for sliding engagement with the chain during said constrained movement of the grappling member along the chain while an upper part of the loop shaped portion includes means for attachment of the grappling member to a pendant line, said inner surface of the loop shaped portion defining in transverse cross-section, an arcuate line, which arcuate line includes a leading portion and a following elongate portion having a radius of curvature substantially greater than than of said leading portion, said following elongate portion serving to engage two successive similarly orientated links of the chain during movement of the grappling member on the chain towards the anchor, the chord subtended by said following portion of the arcuate line forming an obtuse angle with the line from the attachment means to the point on the arcuate line separating said leading portion from the following portion.

Preferably the material of the member is harder than the material of the chain and of the anchor.

An embodiment of the present invention will now be described by way of example with reference to the accompanying drawings wherein.

Figure 1:
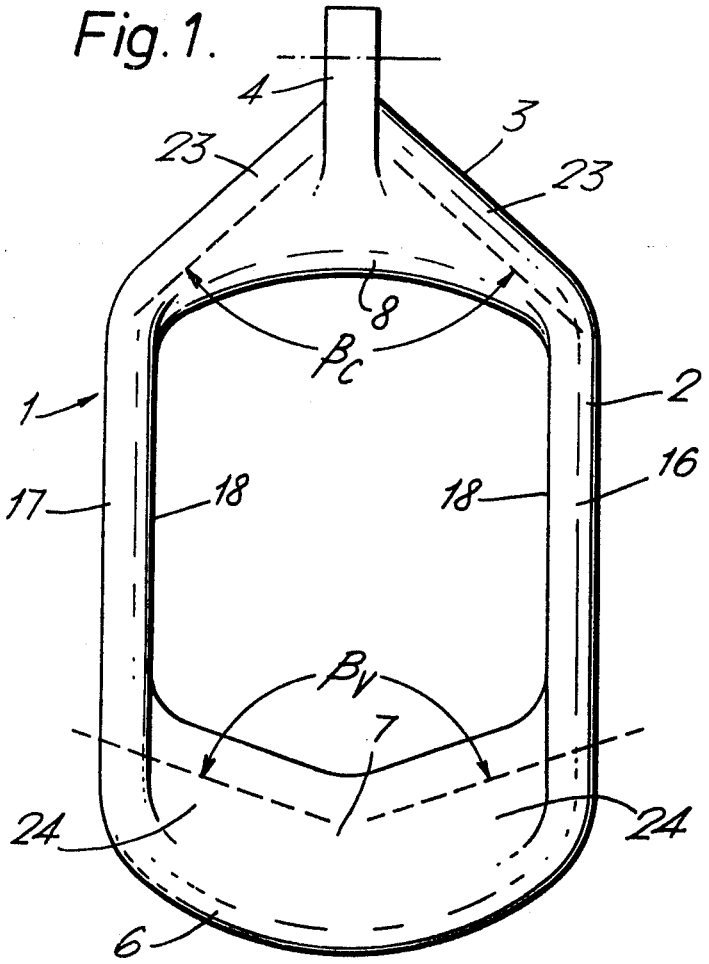
FIG. 1 shows a rear elevational view of an anchor retrieval device or chaser according to the present invention.
Figure 2:
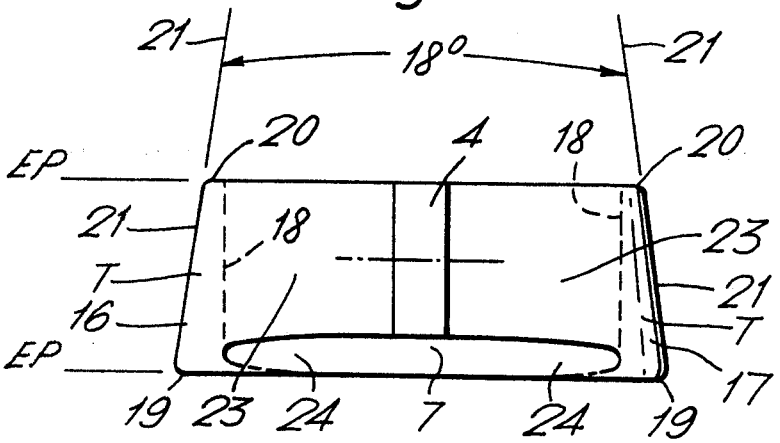
FIG. 2 shows a plan view of the device of FIG. 1.
Figure 3:
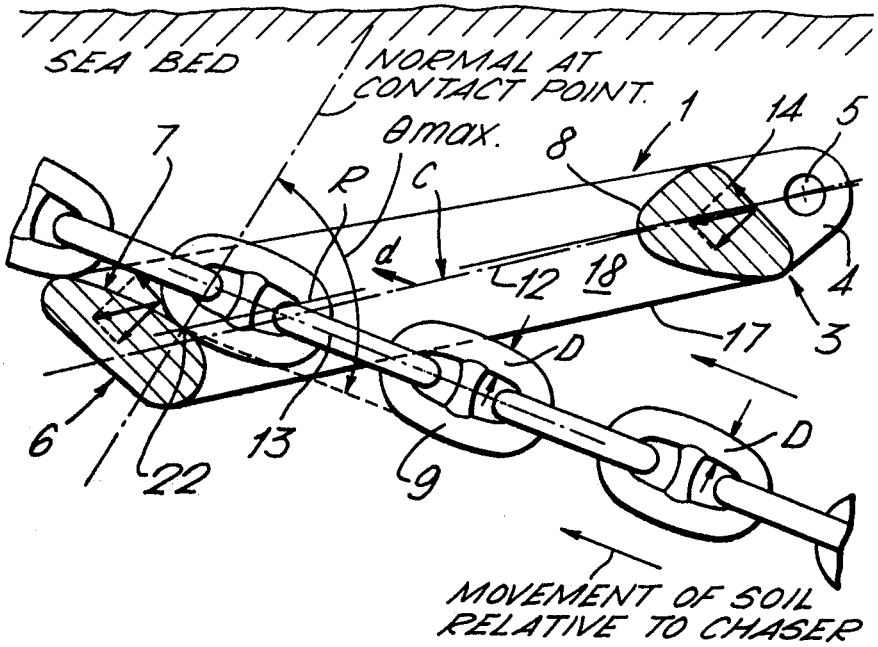
FIG. 3 shows the chaser of FIG. 1 sliding on the anchor chain in the sea bed towards a deeply buried anchor.

Referring to FIGS. 1 to 5 an anchor retrieval device or chaser 1 comprises an annular member 2 having a base portion 6 and a crown portion 3 bearing a lug 4 with a shackle hole 5 for attaching the chaser 1 by means of a shackle to a service cable or pendant (not shown), the annular member 2 being dimensioned to permit the passage therethrough of any of the anchor chain, joining links, swivels, anchor attachment shackle, or anchor shank of the anchor system. The chaser 1 is cast from a suitable wear resistant steel having a hardness well in excess of that of either the chain or the anchor material. The base portion 6 and crown portion 3 of the annular member 2 are formed with curved surfaces 7, 8 adapted to slide in contact with stud-link chain 9 (FIGS. 3 and 4) of diameter D. The medial cross-section of the curved sliding surface 7 of the base is bounded by an arc of radius R = 12D (FIG. 5) cut off by a chord of length $x$ = 4.66D and adjoining a semi-circle of radius $R_1$ chosen to be not less than D, and in this embodiment radius $R_1$ = 1.33D, with the remainder of the cross-sectional shape of the member bearing the sliding surfaces being defined by a semi-circle $R_2$ of radius 0.75D and a straight line 11 joining the extremities of the two semi-circles $R_1$ $R_2$. The centre of the shackle hole 5 of the attachment lug 4 lies on a straight line 12 which passes through the intersection of the arc of radius R = 12D and the semi-circle of radius $R_1$ = 1.33D and forms an angle $\beta$ (FIG. 5) of 143° with the chord length $x$ measured on the side of the chord remote from the centres of curvature of the sliding surfaces. The medial cross-section of the crown portion 3 bearing sliding surfaces is defined by a straight line 14 (FIG. 4) of length 3.36D having each extremity joined by a sequence of tangentially joined circular arcs of radii $R_A$, $R_B$, $R_C$, $R_D$, $R_E$ of 0.75D, 8.8D, 1.33D, 5D and 1.33D respectively. The plane C transverse to the direction of motion of the chaser 1 and containing the before-mentioned straight line 12, on which the lug shackle hole 5 centre is located, is referred to hereinafter and in the claims as the "plane of the chaser" and contains the centre of curvature of the arc of radius $R_c$ of the section of the crown portion 3 of the annular member 2. Line 14 of this section lies at an angle $\alpha_c$ (see FIG. 4) of 60° to the plane of the chaser.

The shackle hole centre 5 is 21.6D distant from the intersection of the plane C of the chaser with the sliding surface 7 on the base portion 6 of the annular member 2. The smallest distance X in the plane of the chaser separating the crown portion sliding surface 8 from the base portion sliding surface 7 is 15.6D (see FIG. 4).

The side limbs 16, 17 of the annular member 2 joining crown portion 3 to base portion 6 having parallel facing inner surfaces 18 13.12D apart and are of truncated triangular cross-section T (FIG. 2) approximately 5D long, 1.3D wide at the trailing edge 19 and 0.5D wide at the leading edge 20. This shape T of cross-section provides opposed forwardly converging external surfaces 21 with an angle of convergence of 18°. These external surfaces 21 provide transverse forces due to soil interaction which have a stabilising effect on the chaser 1 by virtue of the resultant transverse forces from the two surfaces 21 combining to produce a restoring moment about the roll axis R the line joining the shackle hole centre 5 to the contact point 22 between chaser 1 and chain 9 when they are horizontal in the plane C of the chaser deviates from right angles with the vertical plane containing the axis 13 of the chain 9.

Figure 4:
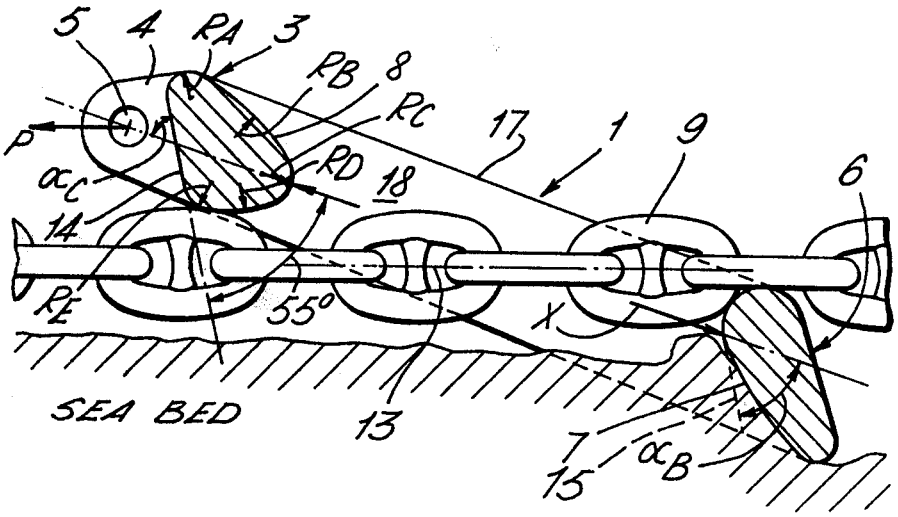
FIG. 4 shows the chaser of FIG. 1 returning along the anchor chain.
Figure 5:
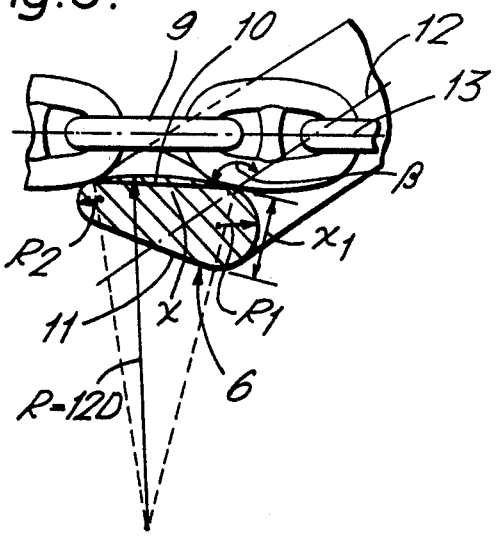
FIG. 5 shows in detail the lower chain engaging surface of the chaser of FIG. 3.

The crown 3 and base 6 portions of the annular member 2 are also formed with burial surfaces 23, 24 (see FIG. 1) arranged such that line intercepts 14, 15 (FIG. 4) of the surfaces 23, 24 with planes parallel to line 12 and at right angles to the plane C of the chaser are inclined at angles $\alpha_B$, $\alpha_c$ of 60° to the plane of the chaser 1. These surfaces 23, 24 are located uppermost on each of the crown 3 and base 6 portions of the annular member 2, adjacent each side of the lug 4 on the crown portion 3 and adjacent each side of the curved sliding surface 7 on the base portion 6, and the surfaces 23, 24 lie within the end planes EP of the annular member 2. The curved sliding surface 7 of the base portion blends by transition curves into the adjacent planar burial surfaces 24 which form a shallow V with an included angle $\beta_v$ (FIG. 1) of 140° when viewed in the direction of line 15 (FIG. 4). This V encourages the chain 9 to ride only on the sliding surface 7 located at the apex of the V. The burial surfaces 23 on the crown portion 3 of the annular member form an inverted V having an included angle $\beta_c$ (FIG. 1) of 96° when viewed in the direction of line 14 (FIG. 4) whilst the sliding surface 8 underneath is blended by transition curves along an arc of radius 18D to merge with the parallel surfaces 18 of the side limbs of the annular member 2.

Although the burial surfaces 23, 24 thus described are substantially planar, they could be curved so that the V configuration would be better described as a U configuration.

Further, although the burial surfaces 23, 24 have been described as integral with the annular bar member 2, they could be located on a separate member flexibly joined to the annular member 2 so that the bar member 2 would have the sliding surfaces 7, 8 whilst the separate member, functioning as a cable depressor, would have at least one of the burial surfaces 23, 24. Combinations of these arrangements are also envisaged together with the possibility of the annular member 2 being replaced by a U-shaped or V-shaped member.

Figure 6:
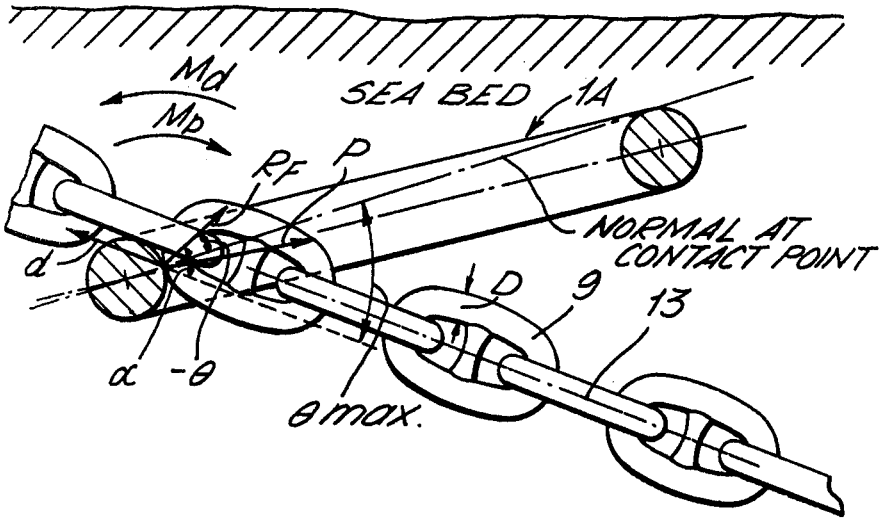
FIG. 6 shows a previous anchor retrieval device being pulled in the sea bed on an anchor chain towards a deeply buried anchor.

FIG. 6 shows a previous chaser 1A fully buried in the sea bed while attempting moving along the inverse catenary curve of a deeply buried anchor cable 9. The chaser 1A comprises a loop of steel having a constant circular cross-section. FIG. 6 shows the forces acting at the point of contact with the attendant moments $M_d$ for drag and $M_p$ for cable pull in balance. Soil drag forces on chaser and pendant line combine to tilt the chaser 1A up from the cable 9. The resultant force, RF, is the sum of the increased drag force, *d*, and the upwards inclined pendant force, *p*. In FIG. 6 $\theta$ max. is the angle between a line parallel to the axis 13 of the chain passing through the point of chaser contact and a line through the point of contact mutually perpendicular to the sliding surface known as the "normal" to the point of contact. By experiment it has been found that the inclination to the horizontal of a chain at the shackle of a deeply buried anchor may be as high as 20° whilst the inclination of a chaser wire-rope pendant of diameter equal to the wire-bar diameter of the chain may be as high as 10°. For a chaser having R = 12D, $\theta$ max will work out at 78.81°. With the chain inclined downwards at 20°, the normal at the contact point between chaser and chain will therefore be at 58.81° to the horizontal. If the friction co-efficient $\mu = 0.8$, $\tan^{-1}\mu = 38.66°$. Therefore, the resultant force, RF, cannot be inclined more than 20.15° to the horizontal if sliding is to occur. Assuming that the drag force, *d*, is exerted on the chaser in a direction parallel to the axis of the chain and that the pendant force, P, is at 10° to the horizontal, the vector diagram of FIG. 6 shows that the magnitude of *d* cannot exceed 26 percent of the magnitude of P if the inclination of RF is not to exceed the 20.15° maximum for sliding to occur. Thus, if the pendant tension is 50 tons, the drag force on the chaser will be 13 tons, the resultant force applied to the taut chain will be 39.6 tons at 40.15° to the axis of the chain, and the normal reaction force exerted by the chain on the chaser will be 30.8 tons.

The chaser 1 of FIG. 1 greatly reduces the drag force, *d*, the reaction force between the chain and chaser at their point of contact and the inclination of P at the point of contact. Reduction of *d* will allow the inclination of the pendant force, P, to approach more closely the said maximum inclination of the resultant force, RF, so that sliding of the chaser can occur at as full development of the inverse catenary of the pendant as possible in order to maximise the ability of the chaser to penetrate deeply below the sea-bed surface. Reduction of the reaction force will decrease the rate of wear at the surfaces in sliding contact. Reduction of the inclination of the pendant force applied at the point of contact between chaser and chain despite full development of an inverse catenary in the pendant will both reduce the reaction force and promote sliding at high angles of inclination of the chain cable.

These improvements are realised in the chaser of FIG. 1 by burial forces being generated on the chaser by the passage of sea bed soil over the burial surfaces 23, 24 and by minimising the penetration resistance of the parts of the chaser 1 in the soil. Both upper and lower burial surfaces 23, 24 will act to reduce the contact pressure on the under surface of the chain whilst the upper burial surface is arranged additionally to depress the forward part of the chaser on to or nearer to the chain despite the lifting component of the force applied by the inclined pendant wire.

The chaser 1 operates in the manner described hereinbefore with the capability of negotiating steeply inclined chain cable to engage on the shank of a deeply buried anchor whereas, from the analysis presented, it may be seen that previous chasers can have little or none of this capability. Additionally, the reduction of contact pressure between chaser and chain produced by the burial surfaces promotes a large reduction in the high rate of wear experienced previously in chaser operation.

It is submitted that the dimensions and shape of the present chaser allow it to negotiate the anchor shackle both when engaging and disengaging from the anchor shank.

It will be understood also that the present invention could readily be embodied in a hook-shaped member with or without an attached cable depressing member bearing a burial surface. The sliding surfaces would be located on the central portion of the U-shaped part of the hook and the burial surfaces could be located adjacent each side of the central portion and extending transversely to the axis of the chain along the arms of the U-shaped part.

I claim:

1. A chaser for placement or removal of a link-chain attached anchor from the sea bed, said chaser comprising an anchor grappling member including a loop shaped portion serving to catch and support the anchor for anchor retrieval or placement, said grappling member being adapted for constrained movement along the chain to or from the anchor, a lower part of the loop shaped portion having an inner surface for sliding engagement with the chain during said constrained movement of the grappling member along the chain while an upper part of the loop shaped portion includes means for attachment of the grappling member to a pendant line, said inner surface of the loop shaped portion defining in transverse cross-section, an arcuate line, which arcuate line includes a leading portion and a following elongate portion having a radius of curvature substantially greater than that of said leading portion, said following elongate portion serving to engage two successively similarly orientated links of the chain during movement of the grappling member on the chain towards the anchor, the chord subtended by said following portion of the arcuate line forming an obtuse angle $\beta$ with the line from the attachment means to the point on the arcuate line separating said leading portion from the following portion.

2. The chaser according to claim 1, wherein said obtuse angle $\beta$ is in the region of 143°.

3. The chaser according to claim 1, including a burial member provided with a burial surface whereby relative movement of sea bed soil over the burial surface gives rise to burial forces transverse to the direction of sliding of the loop portion.

4. The chaser portion according to claim 3, wherein the burial member does not extend substantially outwith the end planes of the loop portion.

5. The chaser according to claim 3, wherein the burial surface is inclined at an angle $\alpha$ of between 45° to 85° to the mid plane of the loop portion and measured in a plane transverse to said mid plane and containing said attachment means.

6. The chaser as claimed in claim 5, wherein said angle $\alpha$ is in the range 50° to 70°.

7. The chaser according to claim 3, wherein there are provided two burial members providing upper and lower burial surfaces.

8. The chaser according to claim 7, wherein the upper burial surface is located on an external surface of the loop portion, and the lower burial surface is located on an internal surface of the loop portion.

9. The chaser according to claim 8, wherein the upper burial surface comprises two surface portions spaced one at each side of said attachment means.

10. The chaser according to claim 9, wherein the surface portions of the upper burial surface are downwardly diverging.

11. The chaser according to claim 8, wherein the lower burial surface comprises two surface portions spaced one at each side of said inner chain engaging surface of the lower part of the loop portion.

12. The chaser according to claim 11, wherein the surface portions of the lower burial surface are upwardly diverging.

13. The chaser according to claim 7, wherein the loop portion comprises crown and base portions linked by side portions, said crown and base portions providing the chain engaging surfaces and the burial surfaces, and said side portions have outer surfaces which converge forwardly.

14. The chaser according to claim 1, additionally including an upper surface for engagement with the anchor chain, which upper chain engaging surface is of curved form.

15. The chaser according to claim 14, wherein the additional upper chain engaging surface has two downwardly converging relatively flat portions joined by a nose portion of substantially smaller radius of curvature.

16. In combination with an anchor link-chain having a link diameter of D, a chaser for placement or removal of an anchor from the sea bed, which anchor is attached to said chain of link diameter D, said chaser comprising an anchor grappling member including a loop shaped portion serving to catch and support the anchor for anchor retrieval or placement, said grappling member being adapted for constrained movement along the chain to or from the anchor, a lower part of the loop shaped portion having an inner surface for sliding engagement with the chain during said constrained movement of the grappling member along the chain while an upper part of the loop shaped portion includes means for attachment of the grappling member to a pendant line, said inner surface of the loop shaped portion defining in transverse cross-section, an arcuate line, which arcuate line includes a leading portion and a following elongate portion having a radius of curvature substantially greater than that of said leading portion, said following elongate portion being defined by an arc of minimum radius 2D with the longest chord contained by the arc being of length not less than 2.9D, in chord subtended by said following portion of the arcuate line forming an obtuse angle $\beta$ with the line from the attachment means to the point on the arcuate line separating said leading portion from the following portion.

17. The combination according to claim 16, wherein the chaser includes an additional upper surface adapted for sliding on the chain when the chaser is moved along the chain away from the anchor said additional surface making sliding engagement with the chain being defined by an arc of radius not less than D with the longest chord contained by the arc being of length not less than 1.6D.

18. The combination according to claim 16, wherein the chaser includes a burial member provided with a burial surface whereby relative movement of the sea bed soil over the burial surface gives rise to burial forces transverse to the direction of sliding of the loop portion.

19. The combination according to claim 18, wherein the chaser is provided with two burial members providing upper and lower burial surfaces.

20. The combination according to claim 16, wherein the material of the chaser is harder than the material of the chain and of the anchor.

* * * * *